US006571178B1

(12) United States Patent
Koch et al.

(10) Patent No.: US 6,571,178 B1
(45) Date of Patent: May 27, 2003

(54) METHOD FOR CURVE RECOGNITION AND AXLE ALIGNMENT IN RAIL VEHICLES

(75) Inventors: Markus Koch, Schwabach (DE); Frank Hentschel, Berlin (DE); Günther Himmelstein, Oberursel (DE); Rolf Krouzilek, Berlin (DE)

(73) Assignee: DaimlerChrysler AB (DE)

( * ) Notice: Subject to any disclaimer, the term of this patent is extended or adjusted under 35 U.S.C. 154(b) by 0 days.

(21) Appl. No.: 09/485,576

(22) PCT Filed: May 19, 1999

(86) PCT No.: PCT/EP99/03430

§ 371 (c)(1), (2), (4) Date: Feb. 11, 2000

(87) PCT Pub. No.: WO99/65751

PCT Pub. Date: Dec. 23, 1999

(30) Foreign Application Priority Data

Jun. 13, 1998 (DE) ..... 198 26 451

(51) Int. Cl.[7] ..... B61F 5/00
(52) U.S. Cl. ..... 702/33; 701/19; 105/168
(58) Field of Search ..... 702/33; 105/168, 105/222, 157.1, 199.2, 3; 701/72, 19, 41, 36

(56) References Cited

U.S. PATENT DOCUMENTS

| | | | | |
|---|---|---|---|---|
| 4,103,547 A | | 8/1978 | Vrabel | 73/146 |
| 4,911,081 A | * | 3/1990 | Meret | 105/168 |
| 6,038,981 A | | 3/2000 | Daberkow et al. | 105/168 |
| 6,161,064 A | * | 12/2000 | Strasser et al. | 105/3 |
| 6,205,382 B1 | * | 3/2001 | Suissa | 180/421 |

FOREIGN PATENT DOCUMENTS

| | | |
|---|---|---|
| DE | 9219042 | 5/1997 |
| DE | 19617003 | 10/1997 |
| EP | 0271592 | 6/1988 |

* cited by examiner

*Primary Examiner*—Kamini Shah
*Assistant Examiner*—Hien Vo
(74) *Attorney, Agent, or Firm*—Webb Ziesenhiem Logsdon Orkin & Hanson P.C.

(57) ABSTRACT

This invention relates to a method on a truck for railway vehicles to measure the curvature of a track and a method for configuring the steering orientation of an axle of a rail truck as a function of the curvature of the track, which axle is rotationally fastened to a truck frame. The curvature of the track is determined by dividing a yaw rate by a translation rate, and the wheels are oriented on the basis of a setpoint steering angle ($\gamma_{setpoint}$) which is calculated by multiplying the track curvature ($\chi$) by one-half the distance between the two axles of the truck.

12 Claims, 2 Drawing Sheets

$$v - \Omega \cdot R \Leftrightarrow x = \frac{1}{R} = \frac{\Omega}{v}$$

METHOD FOR CURVE RECOGNITION AND AXLE ALIGNMENT IN RAIL VEHICLES

BACKGROUND OF THE INVENTION

1. Field of the Invention

This invention relates to a method on a truck for railway vehicles to measure the curvature of a track, and a method for configuring the steering orientation of an axle on a rail truck, which axle is rotationally fastened to a truck frame, as a function of the curvature of the track.

2. Description of the Prior Art

Most of the railway vehicles used in urban transit operations in particular have double-axle trucks. Multiple-axle trucks display poor cornering performance on the tight curves that are frequently required because of the layout of the streets. This phenomenon is observed primarily on railway vehicles, the wheels of which are rigidly connected to the truck frame in terms of their yawing movement.

One solution to this problem teaches that the axle or the wheels are mounted in the truck frame so that they can be steered. A steering movement that corresponds to the curvature of the track can be accomplished by a device that orients the axle or the wheels.

DE 195 38 379 C1 discloses a two-wheel truck with individual-wheel drive for vehicles that run on a guideway with controlled steering, in which the truck, for each axle, has two vertical swivel pins, one located on each side outboard of the wheel tread contact points, whereby—by blocking the position of the swivel pin that is currently on the outside of the curve—the axle is rotated alternately precisely around this blocked swivel pin.

DE 92 19 042 U1 discloses a method for the detection of curves that measures the curvature of the track by means of inductive sensors.

The prior art also includes methods in which the wheels or axles are steered passively. This steering can be accomplished either by the tracking forces or by a mechanical coupling of the axle position with the angle of rotation between the car bodies. One disadvantage of these mechanical solutions, however, is that they make possible only a very approximate and imprecise steering.

SUMMARY OF THE INVENTION

A precise orientation is possible only if the axle is actively controlled, e.g. by means of a servo-drive. The regulation of the steering angle which corresponds to the relative angle between the wheel or axle and the truck frame requires the specification of a steering angle setpoint. In turn, the determination of the steering angle setpoint requires a knowledge of the curvature of the track.

The object of the invention is to create a method to measure the curvature of the track for railway vehicles, so that this value can be used to calculate the setpoint for the regulation of the steering angle.

The invention teaches that this object can be accomplished by calculating the curvature of the track is calculated by dividing a yaw rate by a translation rate, and the wheels are oriented on the basis of a setpoint steering angle that is calculated by multiplying the curvature of the track by one-half the distance between the two axles of the truck.

BRIEF DESCRIPTION OF THE DRAWINGS

The invention is described in greater detail and is illustrated in the accompanying drawings, wherein.

DESCRIPTION OF THE PREFERRED EMBODIMENT

Figure 1:
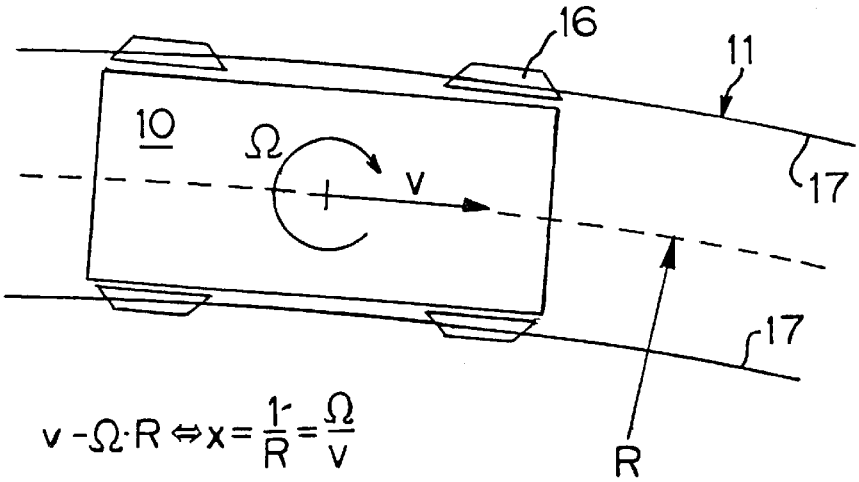
FIG. 1 is a top view of a truck for a railway vehicle showing the ratio of the translation rate and the yaw rate as a function of the curvature of the rails.
Figure 2:
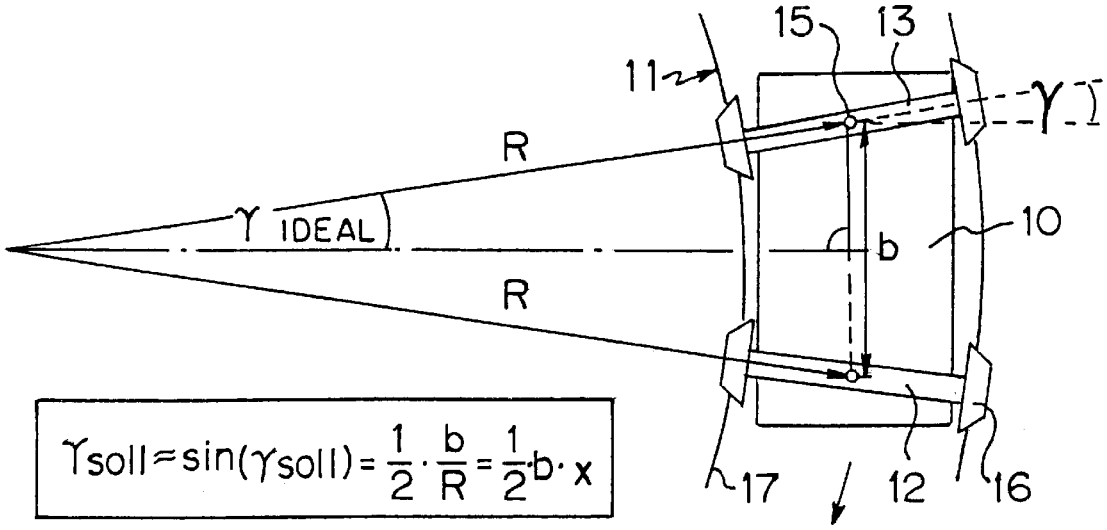
FIG. 2 is a bottom view of a truck for a railway vehicle showing the ideal angular position of the axle as a function of the curvature of the curve.

FIGS. 1 and 2 show a truck 10 for a railway vehicle with axles 12 and 13 to which wheels 16 are fastened. The axles 12 and 13 are fastened in the truck 10. The truck 10 or the axles 12 and 13 are rotationally mounted by means of a centrally located steering joint 15.

Figure 3:
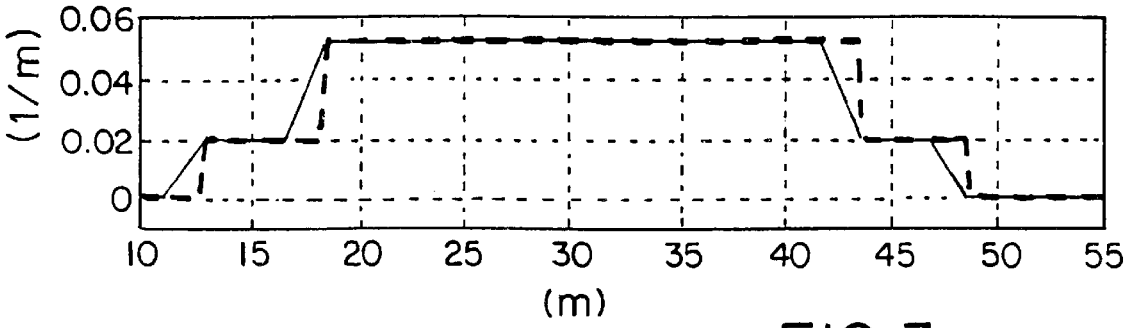
FIG. 3 is a graph showing the path of the curve on the rear axle compared to the approximation by the measurement method during when the railway vehicle is cornering.

The truck 10 is shown as it is traveling at a translation rate v through a curved track 11 which has a radius R. The radius R or a track curvature $\chi$ can be calculated by means that determine a yaw rate $\Omega$. In this case, the track curvature $\chi$ corresponds to the reciprocal of the radius R. The division of the yaw rate $\Omega$ by the translation rate v gives the track curvature $\chi$, as shown in the equation illustrated in FIG. 1. The value derived for the track curvature $\chi$ is used to steer the axles 12 and 13. The ratio between the actual and calculated track curvature $\chi$ is illustrated in FIG. 3.

The yaw rate $\Omega$ is preferably determined by a rate-of-rotation or gyroscopic sensor (not shown), of the type used in navigation.

Figure 5:
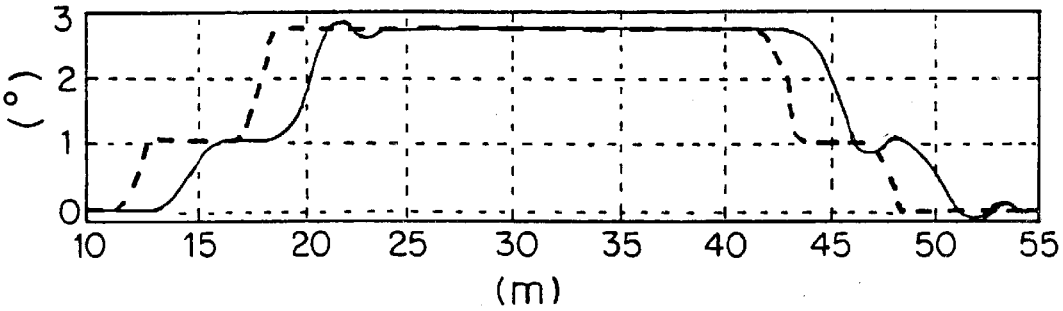
FIG. 5 is a graph showing the ideal steering angle curve ($\gamma_{ideal}$) compared to the calculated setpoint steering angle ($\gamma_{setpoint}$) after the filtering of the yaw rate ($\Omega$).

Because the distance between the wheel flanges of the wheels 16 on an axle 12 or 13 is somewhat less than the distance between the rails 17, the position of the axle in the track channel can shift laterally by several millimeters. Thus impact forces that act on the truck 10 as a result of the fact that the track is frequently not correctly laid can result in a yaw movement. These reciprocating movements, however, have only an insignificant effect on the measurements of the gyroscopic sensor. To eliminate the effect of the reciprocating yaw movement of the truck in the track, the measurement of the yaw rate $\Omega$ is smoothed by means of a low-pass filter, (not shown). The effect of the low-pass filter as the vehicle travels around a curved track is illustrated in FIG. 5.

The axles 12 and 13 are oriented by means of the track curvature $\chi$ thus calculated. The track curvature $\chi$ is thereby used to determine the setpoint steering angle $\gamma_{setpoint}$ used to adjust the axles 12 and 13. The adjustment of the axles 12 and 13 can be carried out by a servo-motor, for example.

The sine of the setpoint steering angle $\gamma_{setpoint}$ of the control system—(not shown)—is calculated by multiplying the track curvature $\chi$ by one-half the distance b between the axles 12 and 13, as in the equation shown in FIG. 2.

Figure 4:
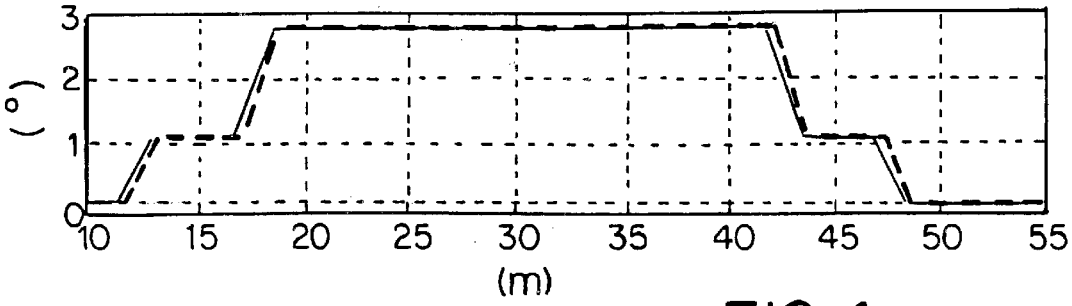
FIG. 4 is a graph showing the ideal steering angle curve ($\gamma_{ideal}$) compared to the calculated setpoint steering angle ($\gamma_{setpoint}$)

Thus there are two approximations when the vehicle enters a curve. The first approximation means that both the curvature on the front axle 12 and also on the rear axle 13 should be known for an exact calculation of the setpoint when the truck enters the curve, but on account of the rotation of the truck, only one value between the two is measured, as shown in FIG. 3. There is also an approximation in the calculation of the steering angle during the entry into the curve, because the geometric relationship illustrated in FIG. 2 is exactly correct only if both axles 12 and 13 are in the curve. These two approximations essentially cancel each other out, so that the calculated $\gamma_{setpoint}$, as shown in FIG. 4, agrees very well with the ideal steering angle $\gamma_{ideal}$.

If a railway vehicle has a plurality of trucks 10, only the setpoint angle $\gamma_{setpoint\ 1}$ for the truck farthest forward in the direction of travel needs to be determined. The additional trucks can assume this setpoint steering angle after some delay. The setpoint steering angles $\gamma_{setpoint\ 1+i}$ for the subsequent trucks in the direction of travel are calculated by delays $\Delta t$ from the first setpoint steering angle $\gamma_{setpoint\ 1}$. The delay $\Delta t$ is determined by dividing the distance $a_i$ between the trailing truck i after the first truck by the translation rate v.

What is claimed is:

1. A method to measure a track curvature on a truck for railway vehicles, comprising the step of calculating the track curvature by-dividing a yaw rate of the truck by a translation rate.

2. The method as claimed in claim 1, wherein to eliminate the influence of reciprocating yaw movement of the truck in a track channel, the yaw rate is smoothed by means of a low-pass filter.

3. The method as claimed in claim 1, wherein the yaw rate is determined by a rate-of-rotation or gyroscopic sensor.

4. A method for configuring the steering orientation of wheels of a railway vehicle that are rotationally fastened to a truck in a curved section of track, comprising the step of orienting the wheels on the basis of a setpoint steering angle which is calculated by multiplying the track curvature by one-half the distance between the two axles of the truck, wherein the track curvature is determined by dividing a yaw rate of the truck by a translation rate.

5. The method as claimed in claim 4, wherein to steer a plurality of trucks on a railway vehicle, only the track curvature and the setpoint steering angle for the first truck is determined, while the setpoint steering angle for the subsequent trucks in the direction of travel is calculated by a time delay from the first setpoint steering angle.

6. The method as claimed in claim 5, wherein the delay is calculated as the distance of the trailing truck from the first truck divided by a translation rate.

7. The method as claimed in claim 2, wherein the yaw rate is determined by a rate-of-rotation or gyroscopic sensor.

8. The method as claimed in claim 4, wherein to eliminate the influence of reciprocating yaw movement of the truck in a track channel, the yaw rate is smoothed by means of a low-pass filter.

9. The method as claimed in claim 4, wherein the yaw rate is determined by a rate-of-rotation or gyroscopic sensor.

10. The method as claimed in claim 4, wherein to steer a plurality of trucks on a railway vehicle, only the track curvature and the setpoint steering angle for the first truck is determined, while the setpoint steering angle for the subsequent trucks in the direction of travel is calculated by a time delay from the first setpoint steering angle.

11. The method as claimed in claim 8, wherein to steer a plurality of trucks on a railway vehicle, only the track curvature and the setpoint steering angle for the first truck is determined, while the setpoint steering angle for the subsequent trucks in the direction of travel is calculated by a time delay from the first setpoint steering angle.

12. The method as claimed in claim 9, wherein to steer a plurality of trucks on a railway vehicle, only the track curvature and the setpoint steering angle for the first truck is determined, while the setpoint steering angle for the subsequent trucks in the direction of travel is calculated by a time delay from the first setpoint steering angle.

* * * * *

UNITED STATES PATENT AND TRADEMARK OFFICE

CERTIFICATE OF CORRECTION

PATENT NO. : 6,571,178 B1
DATED : May 27, 2003
INVENTOR(S) : Markus Koch et al.

It is certified that error appears in the above-identified patent and that said Letters Patent is hereby corrected as shown below:

Column 1,
Lines 59-60, “is calculated by” should read -- by --.
Lines 60-61, “rate, and the wheels are oriented” should read -- rate and orienting the wheels --.

Column 2,
Line 54, “the setpoint” should read -- a setpoint --.
Line 58, “-(not shown)-” should read -- (not shown) --.

Column 3,
Line 20, “by-dividing” should read -- by dividing --.

Signed and Sealed this

Fourth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,571,178 B1
DATED : May 27, 2003
INVENTOR(S) : Markus Koch et al.

It is certified that error appears in the above-identified patent and that said Letters Patent is hereby corrected as shown below:

Title page,
Item [73], Assignee, "DaimlerChrysler AB" should read -- DaimlerChrysler Rail Systems GmbH --.

Signed and Sealed this

Thirteenth Day of January, 2004

JON W. DUDAS
*Acting Director of the United States Patent and Trademark Office*